US005493176A

United States Patent [19]

Persyk

[11] Patent Number: 5,493,176

[45] Date of Patent: Feb. 20, 1996

[54] PHOTOMULTIPLIER TUBE WITH AN AVALANCHE PHOTODIODE, A FLAT INPUT END AND CONDUCTORS WHICH SIMULATE THE POTENTIAL DISTRIBUTION IN A PHOTOMULTIPLIER TUBE HAVING A SPHERICAL-TYPE INPUT END

[75] Inventor: Dennis E. Persyk, Barrington, Ill.

[73] Assignee: Siemens Medical Systems, Inc., Iselin, N.J.

[21] Appl. No.: 247,746

[22] Filed: May 23, 1994

[51] Int. Cl.[6] ..... H01J 31/50

[52] U.S. Cl. ..... 313/537; 313/532

[58] Field of Search ..... 313/532, 537, 313/544, 541, 383

[56] References Cited

U.S. PATENT DOCUMENTS

| | | | |
|---|---|---|---|
| 3,885,178 | 5/1975 | Goehner | 313/95 |
| 4,006,376 | 2/1977 | Faulkner et al. | 313/95 |
| 5,374,826 | 12/1994 | LaRue et al. | 313/532 |

FOREIGN PATENT DOCUMENTS

| | | | |
|---|---|---|---|
| 2-15981 | 4/1990 | Japan | H01J 31/50 |
| 1137669 | 3/1966 | United Kingdom . | |

OTHER PUBLICATIONS

Eric Munro, Numerical Modeling of Electron and Ion Optics on Personal Computers, Nov./Dec. 1990, pp. 1657–1665, J. Vac. Sci. Tech.

C. D'Ambrosio et al., Photon Counting With a Hybrid Photomultiplier Tube (HPMT), 1994, pp. 389–397, Nuclear Instruments & Methods in Physics Res.

A paper by Szawlowski et al. distributed during the Nuclear Science Symposium & Med. Imaging Conference, Oct. 31, 1993–Nov. 6, 1993.

Illes P. Csorba, Image Tubes, pp. 61–63.

*Primary Examiner*—Donald J. Yusko
*Assistant Examiner*—Michael Day
*Attorney, Agent, or Firm*—Mark H. Jay

[57] ABSTRACT

A photomultiplier uses an avalanche photodiode as a position-sensitive anode. The envelope of the photomultiplier has a flat input end. Electrically conductive regions mounted to the input end are configured to produce at the input end a potential distribution characteristic of a photomultiplier with a spherical-type input end as measured in a transverse plane immediately adjacent the spherical-type input end. A photocathode is located inside the photomultiplier and is electrically connected to the electrically conductivew regions. Advantageously, the envelope has flat sides and a square cross-section; in this instance, conductors are run along the sides to produce within the envelope a potential distribution characteristic of a photomultiplier which is cylindrical in cross-section, as measured at flat surfaces having the same shape as the envelope.

4 Claims, 3 Drawing Sheets

PHOTOMULTIPLIER TUBE WITH AN AVALANCHE PHOTODIODE, A FLAT INPUT END AND CONDUCTORS WHICH SIMULATE THE POTENTIAL DISTRIBUTION IN A PHOTOMULTIPLIER TUBE HAVING A SPHERICAL-TYPE INPUT END

BACKGROUND OF THE INVENTION

The invention relates to photodetectors, and more particularly relates to photodetectors of the photomultiplier tube type. In its most immediate sense, the invention relates to photomultiplier tubes of the type which are suitable for use in the detectors of gamma cameras and PET (Positron Emission Tomography) scanners such as are used in nuclear medicine.

A photomultiplier tube is a device which converts incident light radiation to an electrical signal. In a photomultiplier tube, light is made incident upon a photocathode, which produces photoelectrons in response. The photoelectrons are usually directed to a series of dynodes made e.g. of metal alloys whose surface oxides have high secondary emission ratios. (Examples of such alloys are AgMg, CuBe and NiAl, whose surface oxides are, respectively, MgO, BeO and $Al_2O_3$.) When a photoelectron strikes a dynode, the impact causes a plurality (typically, from 3 to 30) secondary electrodes to be emitted, which produce yet more secondary electrons when they strike the next dynode in the series. At the end of the series, the original photoelectrons have been greatly multiplied in number, and when the final electron beam strikes the anode of the photomultiplier tube it produces an output signal which is large enough for use in subsequent electronic circuitry, even if the originally-incident light is of very low intensity.

Photomultiplier tubes are used in large numbers in scintillation cameras (e.g. gamma cameras and PET scanners). In these devices, radiation is made incident upon a scintillation crystal, where the radiation interacts with the crystal to create a flash of scintillation light (a "scintillation event"). The light from this scintillation event is viewed by photomultiplier tubes, which produce electrical output signals that are used in subsequent circuitry and data processing apparatus.

In both classes of devices, photomultiplier performance is critical. Furthermore, in both classes of devices, spatial resolution (generally considered the key measure of performance) depends upon the size of the photomultiplier tubes; the smaller the tubes, the better the resolution. (This is because a conventional photomultiplier tube only indicates whether light from a scintillation event is present at its input surface and not where that event is located. To determine the locations of scintillation events with sufficient precision, i.e. with a spatial resolution which is better than the dimensions of the photocathode of the photomultiplier tube, it is necessary to use a plurality of photomultiplier tubes and to cause the scintillation light to spread out over an area which is sufficiently large to encompass more than one photomultiplier tube at a time. In conventional detector configurations, photomultiplier tubes having diameters of 75 mm can produce spatial resolution of 4 mm; photomultiplier tubes having diameters of 50 mm can produce spatial resolutions on the order of 3 mm.) However, because the expense of photomultiplier tubes is substantial and generally does not vary with tube size, and because each photomultiplier tube requires electrical circuitry to e.g. provide power, control gain, etc., designers of gamma cameras and PET scanners are constrained to trade off performance versus cost and to accept larger photomultiplier tubes and degraded spatial resolution as necessary consequences of manufacturing an affordable instrument.

It has recently been proposed to use semiconductor diodes or avalanche photodiodes ("APD") instead of the dynodes and anode which are conventionally employed in photomultiplier tubes; the resulting combination device has been referred to as a Vacuum Avalanche Photodiode or a Hybrid Photomultiplier Tube ("VAPD" or "HPMT"). This produces a position-sensitive device, improves the linearity of the device and also improves the signal-to-noise ratio at the output.

Where an APD is so employed, the resulting VAPD or HPMT has a potential capability to produce substantial cost savings in the detectors of gamm cameras and PET scanners. This is because it would be possible to use fewer VAPDs or HPMTs and to thereby reduce per-tube associated costs.

However, for such a resulting VAPD or HPMT to be technically feasible in a gamma camera, the light image at the photocathode must be accurately minified at the APD. This would not be so if, as is conventional, the resulting VAPD or HPMT uses a glass envelope with a flat input end and a conventional photocathode.

This is because a conventional photocathode structure, mounted to the flat input end of a glass envelope, applies the same potential to all points on the input end. This would distort the response of the tube if the tube were to be position-sensitive; in a position-sensitive device, changes of location of input light will not produce appropriately corresponding changes of location at the anode (APD). As a result, the resulting VAPD or HPMT would produce distorted output signals.

Furthermore, such a VAPD or HPMT would also be unsuitable for PET scanner applications. A PET scanner works by detecting pairs of annihilation quanta which are simultaneously emitted from a common annihilation site. When such "coincidence detection" techniques are utilized, the system "looks" for two quanta which occur within tens of nanoseconds, and perhaps even within nanoseconds, of each other. It is therefore important that the time response of the VAPD or HPMT be independent of the location of the scintillation event (e.g. at the center of the input end of the photomultiplier tube or at the edge thereof).

This would not be so in VAPDs or HPMTs with flat input ends. This is because photoelectrons from the center of the photocathode would arrive earlier (would have a shorter "transit time") at the avalanche photodiode than would photoelectrons from the edge of the photocathode, and the size of the flat input end would would make the discrepancy in timing unacceptably large.

It would therefore be advantageous to provide a photomultiplier with a flat input end and an APD which would accurately minify onto the APD the light image at the input end and which would make the photoelectron transit time independant of location on the photocathode.

One object of the invention is to provide a photomultiplier with a flat input end and an APD, which would cause light images at the input end to be accurately minified on the APD and would also provide for a transit time which was independant of location on the photocathode.

Another object is, in general, to improve on known devices of this general type.

The invention proceeds from the known proposition that an ideal shape for a photocathode in a photomultiplier tube is a section of a sphere. In accordance with the invention, a model is constructed of the potential distribution in a photomultiplier tube with a spherical-type input end, i.e. in a photomultiplier tube in which the input end is a section of a sphere. Furthermore, a model is constructed to determine what this potential distribution would be, as measured in a transverse plane immediately adjacent the input end. Then, a photocathode structure is configured to produce the thus-determined potential distribution. This is done by applying, to the input end, metallized regions which produce the desired potential distribution when connected to appropriate sources of electrical potential. A photocathode is then applied to the interior of the photomultiplier such as to be electrically connected to the metallized regions. When such a photocathode structure is affixed at a flat input end of the glass envelope of a photomultiplier tube, the photomultiplier tube acts like a photomultiplier tube with a spherical-type input end.

Advantageously, the glass envelope has flat sides and is shaped to be rectangular (further advantageously, square) in cross-section. This permits the photomultipliers to be densely packed together. In this embodiment, conductors are mounted to the sides and produce on them a potential distribution characteristic of a photomultiplier which is cylindrical in cross-section, as measured at flat surfaces having the same shape as the envelope.

Further advantageously, the photocathode is deposited using conventional techniques onto metallized regions located inside the envelope. Electrodes, such as Kovar pins, are placed in the envelope; the interior ends of the electrodes make contact with the metallized regions and the exterior ends of the electrodes are available for connection to suitable electrical potentials.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

For clarity, the Figures are schematic and are not to scale.

Figure 1:
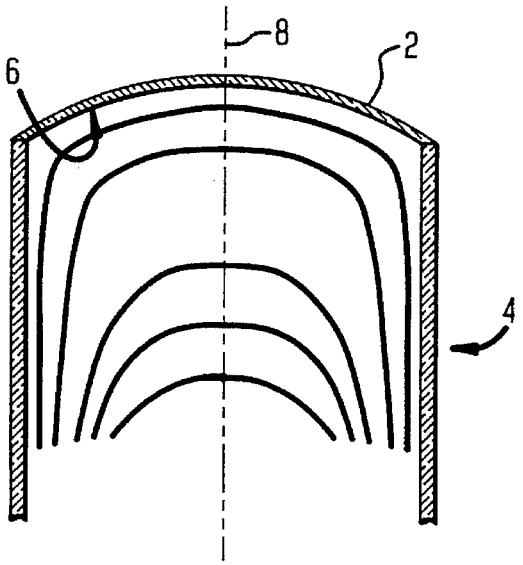
FIG. 1 (PRIOR ART)
FIG. 1 shows equipotential lines within a conventional photomultiplier with a spherical-type input end and a circular cross-section.

Conventionally, as illustrated in FIG. 1, the input end 2 of a photomultiplier tube generally indicated by reference numeral 4 is formed from a faceplate (of e.g. Kovar-sealing glass) and a photocathode is applied (as by deposition) onto the interior surface 6 of the faceplate and connected to a single source of electrical potential (connection and source not shown). Where the faceplate has a spherical-type shape and the photomultiplier 4 has a circular cross-section and focussing electrode(s) which are appropriately symmetric with respect to axis 8, the potential distribution within the envelope is highly symmetrical. With such a symmetrical potential distribution, light images on the input end 2 would be accurately minified onto an APD which serves as the anode of a photomultiplier, and the transit time required for photoelectrons to reach the APD would not vary with location on the photocathode.

However, it is not feasible to use a photomultiplier with a spherical-type input end in the detector of a scintillation camera (e.g. a gamma camera or a PET scanner). This is because the photomultipliers must be in intimate operative relation with the scintillation crystal. For this reason, the exterior surface of the input end of such photomultipliers must be flat.

For smaller photomultipliers, e.g. those having diameters of two inches or less, the input end can have a flat exterior surface and a spherical-type interior surface upon which the photocathode can be applied. However, for photomultipliers having diameters exceeding two inches, this is not feasible because the periphery of the input end must be quite thick. Therefore, for photomultipliers which exceed two inches in diameter, there is no alternative but to use a flat input end with a flat interior surface and to apply the photocathode to that flat interior surface.

When a photocathode is deposited on the flat interior surface of a flat input end of a photomultiplier, the potential distribution within the envelope is quite different from that shown in FIG. 1. As a result, images on a flat input end of such a photomultiplier will be distorted when projected onto an APD and the transit time for photoelectrons from the center of the photocathode will be shorter than for photoelectrons from the periphery of the photocathode.

Figure 2:
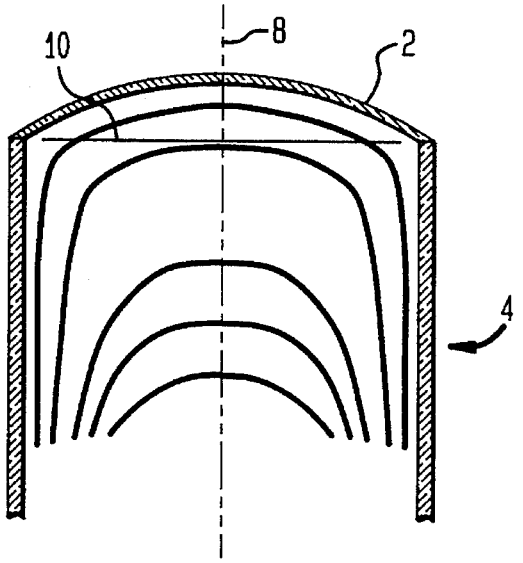
FIG. 2 (PRIOR ART)
FIG. 2 shows a transverse plane immediately adjacent the spherical-type input end of the FIG. 1 photomultiplier.
Figure 3:
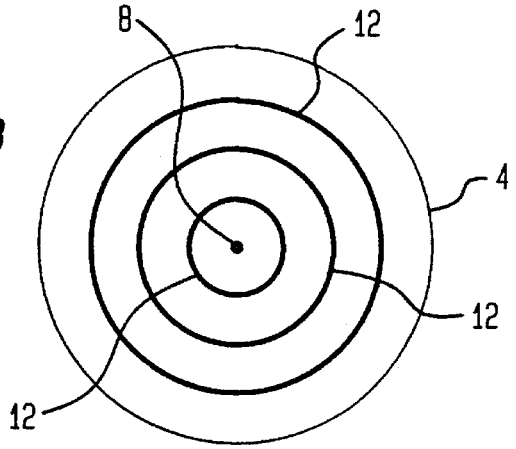
FIG. 3 shows how the equipotential lines of FIG. 1, as measured in the FIG. 2 transverse plane, can be produced by a photocathode having an annular configuration.

To correct for these factors, the FIG. 1 potential distribution in a photomultiplier with a spherical-type input end and a circular cross-section is modelled. Such models are constructed using computer programs which solve for the interior potential distribution of a bounded region or surface, in two or three dimensions; the known potentials on the exterior and on interior conductors are specified, and the program determines the potentials at all other desired points. (Such computer programs, of the type designed to run on a personal computer, are discussed in *J. Vac. Sci. Technol.* B 8 (6), pp. 1657–1665, Nov/Dec 1980). Next, this potential distribution, as it would be measured in a transversely-extending plane 10 immediately adjacent the input end 2, is computed (see FIG. 2). Such a computation results in annular equipotential lines 12 which are centered on the axis of the photomultiplier tube, as shown in FIG. 3. Such a potential distribution can be approximated by applying conductive annuli to the interior surface of a flat faceplate and connecting those annuli to appropriate electrical potentials.

Figure 4A:
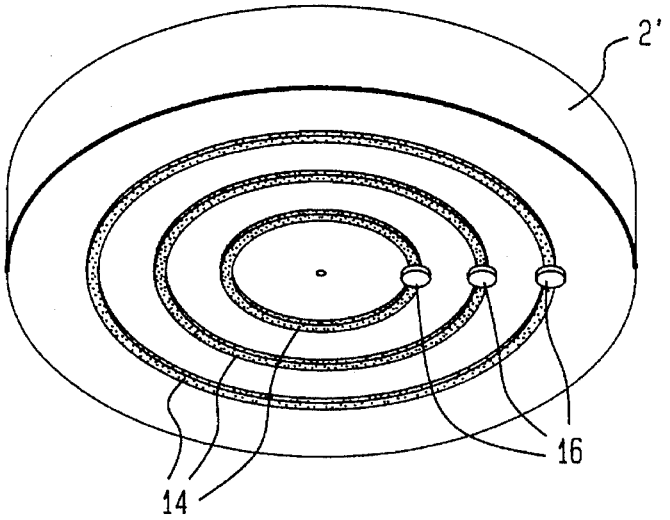
FIGS. 4A and 4B illustrate the input end of a preferred embodiment of the invention.
Figure 4B:
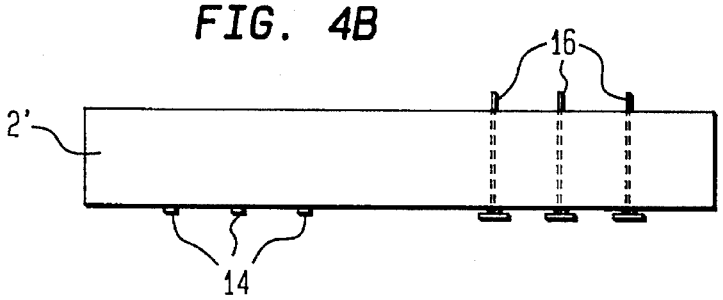

In accordance with the preferred embodiment of the invention (see FIGS. 4A and 4B), annular regions 14 of a flat faceplate 2' are metallized (as by application of metallic, e.g. aluminum stripes) and connected to appropriate electrical potentials using electrodes 16 which pass through the faceplate. Advantageously, the faceplate 2' is of Kovar-sealing glass, the electrodes 16 are of Kovar, and wire conductors (not shown) connect the electrodes to suitable sources (not shown) of electrical potential, but these materials and connection scheme are not required. The number of annular regions 14 is determined by the desired similarity between the ideal potential distribution which would be produced by a spherical-type faceplate (e.g. faceplate 2 in FIG. 1) and the actual potential distribution produced by the production unit.

After the annular regions 14 have been metallized, a photocathode is applied to them. Conventionally, this will be done by deposition. The result is a structure which forms a set of concentric annular photocathodes at different electrical potentials, the set producing a potential distribution on the flat faceplate 2' which closely approximates the potential distribution which would have been produced on a transversely-extending plane 10 by the photocathode on a spherical-type faceplate 2'. With such a potential distribution, images on the input end of a photomultiplier tube in accordance with the preferred embodiment of the invention are accurately minified on an APD, and transit times of photoelectrons do not vary with location on the photocathode.

Figure 5:
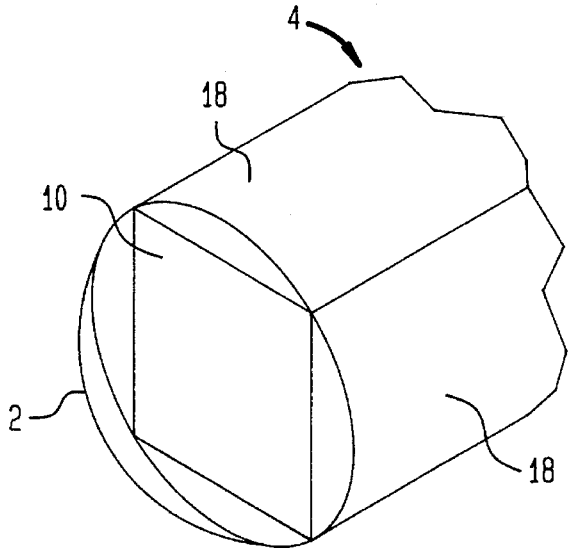
FIG. 5 illustrates modelling methodology which is used to produce a preferred embodiment of the invention having flat sides.

Advantageously, the envelope of the photomultiplier has a square cross-section. This permits the photomultipliers to be densely packed. To produce within such an envelope a potential distribution similar to that shown in FIG. 1, the FIG. 1 potential distribution—as it would be measured in flat side walls which have the same shape as the envelope (see FIG. 5)—is computed, using the same computational methodology used with respect to the plane 10. The resulting potential distribution can be simulated by routing conductors along the side walls (see FIG. 7); the conductors need not be transparent since no photocathodes are located on the side walls.

Figure 6:
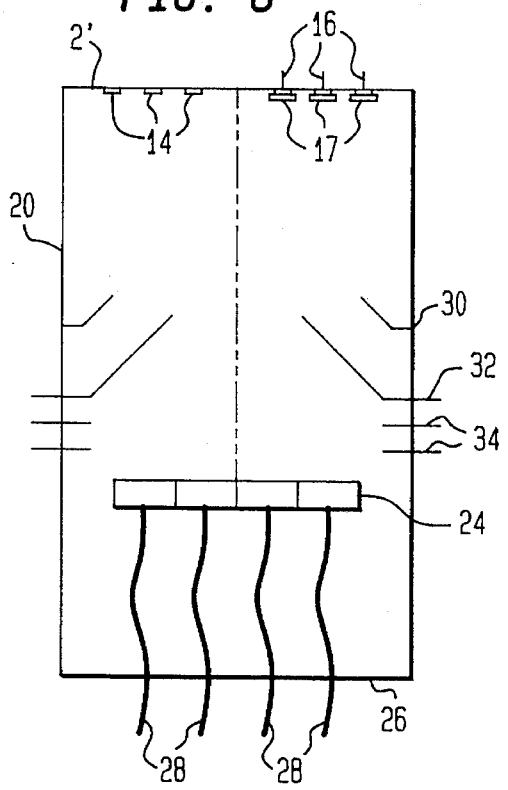
FIG. 6 is a schematic cross-sectional view of a preferred embodiment of the invention.

FIG. 6 is a schematic diagram of a preferred embodiment of the invention. As can be seen there, the preferred embodiment has an envelope 20 with a square cross-section and a flat input end formed by a faceplate 2' of Kovar-sealing glass. Annular aluminized regions 14 are located on the interior surface of the faceplate 2' and are connected to suitable sources of electrical potential (not shown) via Kovar pins 16, which extend through the faceplate 2'. A photocathode is applied over the aluminized regions.

As in conventional image tubes, the preferred embodiment has a cathode aperture 30 (which may be a ring of Kovar), an anode cone 32 (which may likewise be a ring of Kovar) and one or more shaping electrodes 34 (which may be a "saddle ring" of Kovar). These components are known in the art and will not be further described.

The preferred embodiment also has an array 24 of semiconductor diodes, advantageously a 4×4 array of silicon avalanche photodiodes configured to produce impact ionization gain and avalanche gain, located adjacent the rear end 26 of the envelope 26. Leads 28 from the array 24 exit at the rear end 26 for connection to subsequent electronic circuitry.

Figure 7:
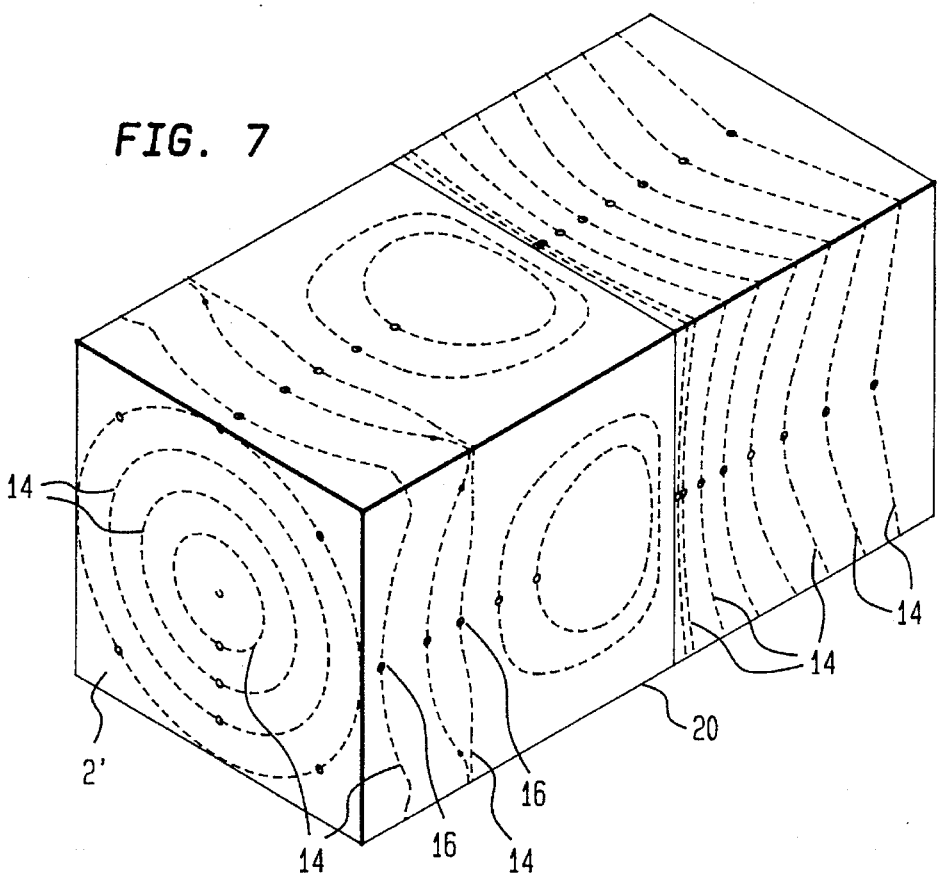
FIG. 7 is a schematic three-dimensional sketch showing the pattern of metallized regions on the interior surface of the preferred embodiment shown in FIG. 6.

FIG. 7 schematically shows the pattern of metallized regions 14 on the interior surface of the faceplate 2' and the envelope 20. Each region 14 is connected to the outside by a pin 16 of Kovar; the pin is in turn connected to a suitable source of electrical potential (not shown). Within the envelope 20, the potential distribution approximates the potential distribution which would exist within a conventional photomultiplier tube having a spherical-type input end and a cylindrical envelope.

Although a preferred embodiment has been described above, the scope of the invention is limited only by the following claims:

I claim:

1. A photomultiplier, comprising:

an envelope with an interior, an interior surface and a flat input end;

metallized conductive regions mounted to the interior surface, the regions being configured such that when the regions are connected to appropriate sources of electrical potential, the regions produce at the input end a potential distribution characteristic of a photomultiplier with a spherical-type input end as measured in a transverse plane immediately adjacent said spherical-type input end;

a photocathode applied to the interior surface and being electrically connected to the conductive regions; and a semiconductor photodiode disposed within the envelope.

2. The photomultiplier of claim 1, wherein the envelope has flat sides and is rectangular in cross-section and further comprising conductors located on said flat sides, the conductors being configured to produce at the sides a potential distribution characteristic of a photomultiplier which is cylindrical in cross-section, as measured at flat surfaces having the same shape as the envelope.

3. The photomultiplier of claim 2, wherein the envelope is square in cross-section.

4. The photomultiplier of claim 1, wherein the semiconductor photodiode is an avalanche photodiode configured to produce both impact ionization gain and avalanche gain.

* * * * *